US007950458B2

(12) United States Patent
Livingstone

(10) Patent No.: US 7,950,458 B2
(45) Date of Patent: May 31, 2011

(54) DRILLING, COMPLETING AND STIMULATING A HYDROCARBON PRODUCTION WELL

(75) Inventor: James I. Livingstone, Calgary (CA)

(73) Assignee: J. I. Livingstone Enterprises Ltd., Calgary (CA)

( * ) Notice: Subject to any disclaimer, the term of this patent is extended or adjusted under 35 U.S.C. 154(b) by 358 days.

(21) Appl. No.: 12/056,131

(22) Filed: Mar. 26, 2008

(65) Prior Publication Data

US 2008/0236809 A1 Oct. 2, 2008

Related U.S. Application Data

(60) Provisional application No. 60/908,018, filed on Mar. 26, 2007.

(51) Int. Cl.
*E21B 36/00* (2006.01)
*E21B 43/34* (2006.01)

(52) U.S. Cl. ..... 166/302; 166/61; 175/314

(58) Field of Classification Search ..... 166/57, 166/302, 380, 61, 60, 205; 175/314
See application file for complete search history.

(56) References Cited

U.S. PATENT DOCUMENTS

| | | | | |
|---|---|---|---|---|
| 4,344,485 | A | 8/1982 | Butler | |
| 6,015,015 | A | 1/2000 | Luft et al. | |
| 6,416,840 | B1 | 7/2002 | Miyamori et al. | |
| 6,854,534 | B2 | 2/2005 | Livingstone | |
| 6,892,829 | B2 | 5/2005 | Livingstone | |
| 7,066,283 | B2 | 6/2006 | Livingstone | |
| 7,090,018 | B2 | 8/2006 | Livingstone | |
| 7,093,675 | B2 | 8/2006 | Pia | |
| 7,121,342 | B2 | 10/2006 | Vinegar et al. | |
| 7,204,327 | B2 | 4/2007 | Livingstone | |
| 2004/0079553 | A1 * | 4/2004 | Livingstone | 175/61 |
| 2006/0070739 | A1 * | 4/2006 | Brooks et al. | 166/299 |
| 2007/0284107 | A1 * | 12/2007 | Crichlow | 166/302 |

OTHER PUBLICATIONS

SPE 69709 "Promising Progress in Field Application of Reservoir Electrical Heating Methods", R. Sierra, Uentech Intl. Corp.; B. Tripathy, Computer Modeling Group; J.E. Bridges, JEB Research; and S.M. Farouq Ali, Pearl Laboratories Canada Ltd., pp. 1 through 17.

Hussein Alboudwarej, et al., "Highlighting Heavy Oil", 2006, pp. 34 through 63.

A. Sahni, et al., "Electromagnetic Heating Methods for Heavy Oil Reservoirs", SPE 62550, US Department of Energy Lawrence Livermore National Laboratory, May 1, 2000, 12 pages.

* cited by examiner

*Primary Examiner* — Giovanna C Wright
*Assistant Examiner* — Yong-Suk Ro
(74) *Attorney, Agent, or Firm* — Bennett Jones LLP

(57) ABSTRACT

An apparatus and method for drilling a well in a heavy oil or bitumen reservoir for in situ recovery of heavy oil and bitumen is provided. More particularly, an apparatus and method for drilling, completing and/or stimulating a heavy oil or bitumen well in a heavy oil or bitumen reservoir is provided, comprising: providing a concentric drill string having an inner tube and an outer tube defining an annulus therebetween, the outer tube further having a plurality of slots sealed with a temporary filler material; drilling a borehole into the reservoir using a drilling member connected at the lower end of the concentric drill string and delivering drilling medium through one of the annulus or inner tube and extracting the exhaust drilling medium through the other of the annulus or inner tube; leaving the concentric drill string in the well after drilling of the borehole is completed; and removing the temporary filler material to expose the plurality of slots in the outer tube and form a slotted liner.

14 Claims, 9 Drawing Sheets

Fig. 3a, 3b, and 3c

DRILLING, COMPLETING AND STIMULATING A HYDROCARBON PRODUCTION WELL

This application claims the benefit under 35 U.S.C. 119(e) of U.S. Provisional Application No. 60/908,018, filed Mar. 26, 2007.

FIELD OF THE INVENTION

This application relates to a method and apparatus for drilling and completing a well for in situ recovery of heavy oil or bitumen from carbonate and sandstone reservoirs. More particularly, the method and apparatus herein uses either concentric drill string or single wall drill string to drill and complete a well. In one embodiment, a portion of the outer tube of the concentric drill string or the wall of the single wall drill string comprises a plurality of temporarily sealed slots and/or induction heaters and may also be used to stimulate the well.

BACKGROUND OF THE INVENTION

The petroleum industry uses many different methods of in situ stimulation of heavy oil and bitumen present in various carbonate and sandstone reservoirs where the oil is too deeply buried to be mined. In many reservoirs, the heavy oil or bitumen is so viscous that it needs to be warmed in order to flow at economic rates. Steam Assisted Gravity Drainage (SAGD) as described in U.S. Pat. No. 4,344,485 (Butler, Aug. 17, 1982), Cyclic Steam Stimulation (CSS) or "huff and puff", In situ Combustion, Waterflooding, Miscible carbon dioxide enhanced oil recovery ($CO_2$-EOR), vapor-assisted petroleum extraction (VAPEX), and Downhole Heaters are some of the more common methods. Current drilling methods for drilling wells useful for in situ stimulation and production of heavy oil/bitumen generally use a conventional, single wall drill string that uses a conventional or underbalanced mud system.

Conventional drilling methods using single wall drill string require that the drill cuttings and mud be returned to surface on the outside of the single wall drill string. In certain reservoirs, using single wall drill string can result in formation damage and serious lost circulation problems. Lost circulation is loss of substantial quantities of drilling mud to an encountered formation during borehole drilling. This is evidenced by a total or drastic reduction of returning mud and a reduction in the volume of mud in the mud pits. The following could cause lost circulation: borehole pressure (mud pressure) being in excess of the formation pressure; damaged formations due to reckless drilling; pipe surging at high speeds; fractured, fissured or faulted formations; limestone regions, which are vuggy and very coarse; permeable rocks like pebbles, reefs and irregular limestone, gravels and conglomerates.

The undesirable effects of lost circulation include: loss of drilling energy; sudden undesirable speed increase of the rotary; deflection of the bit along joint planes or even breaking of the bit; drilling fluid may be totally lost, hence increased cost of operation; time wasted in pulling back and/or combating lost circulation; drop in annular level may cause blow out in over-pressured or gas-bearing formations; loss of information from the down-hole; and the chances of stuck-pipe and fishing exercise are increased, if lost circulation occurs in an aquiferous zone, or slightly above it, then completion and development of the borehole may be impaired.

When drilling in formations such as oil sand and oil shale, damage to the formation may also occur when drilling back up the hole to remove the drill string. Hence, removal of the drilling apparatus from the drilled hole may also result in lost circulation. Thus, it would be desirable at the very least to drill and complete a well without having to remove the drill string after drilling the borehole.

Furthermore, borehole cleaning in heavy oil and bitumen reservoirs is major problem and requires additional drilling time and money and may result in increased formation damage. Running production casing or a slotted liner may be very difficult when the well bore hasn't been properly cleaned.

The present application uses both single wall drill string and dual wall (concentric) drill string that can remain downhole to now operate as a production well, a stimulation well or both. By eliminating the need to drill back up the hole, the likelihood of lost circulation can be reduced.

Use of dual wall drill pipe or dual wall coiled tubing to drill the well will further reduce drilling damage and lost circulation problems. Hole cleaning is much easier and more effective when using dual wall drill string, as the drill mud and cuttings travel up the inside tube. This avoids contact with the formation and agents such as chemicals and foam can be added to assist in borehole cleaning by delivering them through the annulus formed between the inner and outer tubes of the concentric drill string The method and apparatus as described in the present application can also be used to produce and/or stimulate the flow of heavy oil/bitumen, either alone or in combination with other well stimulation techniques known in the art.

SUMMARY OF THE INVENTION

In one broad aspect, a method for drilling, completing and stimulating a heavy oil or bitumen well in a heavy oil or bitumen reservoir is provided, comprising:

- providing a concentric drill string having an inner tube and an outer tube defining an annulus therebetween, the outer tube comprising at least one induction heater;
- drilling a borehole into the reservoir using a drilling member connected at the lower end of the concentric drill string and delivering drilling medium through one of the annulus or inner tube and extracting the exhaust drilling medium through the other of the annulus or inner tube;
- leaving the concentric drill string in the well after drilling of the borehole is completed; and
- heating the outer tube of the concentric drill string using the at least one induction heater to stimulate the flow of the heavy oil or bitumen in the reservoir.

In one embodiment, the inner tube of the concentric drill string can also be used as a production tube for removing the flowing heavy oil or bitumen to surface.

In another broad aspect, a method for drilling, completing and stimulating a heavy oil or bitumen well in a heavy oil or bitumen reservoir is provided, comprising:

- providing a single wall drill string comprising at least one induction heater;
- drilling a borehole into the reservoir using a drilling member connected at the lower end of the single wall drill string and delivering drilling medium through the single wall drill string and extracting the exhaust drilling medium through an annulus formed between the single wall drill pipe and the borehole wall;
- leaving the single wall drill string in the well after drilling of the borehole is completed; and heating the single wall drill string using the at least one induction heater to stimulate the flow of the heavy oil or bitumen in the reservoir.

In one embodiment, the method further comprises inserting a production tube through the single wall drill string once drilling is completed for removing the flowing heavy oil or bitumen to surface. In the alternative, the single wall drill string itself can be used to remove the flowing heavy oil or bitumen to surface.

In one broad aspect, a method for drilling, completing and/or stimulating a heavy oil or bitumen well in a heavy oil or bitumen reservoir is provided, comprising:

providing a concentric drill string having an inner tube and an outer tube defining an annulus therebetween, the outer tube further having a plurality of slots sealed with a temporary filler material;

drilling a borehole into the reservoir using a drilling member connected at the lower end of the concentric drill string and delivering drilling medium through one of the annulus or inner tube and extracting the exhaust drilling medium through the other of the annulus or inner tube;

leaving the concentric drill string in the well after drilling of the borehole is completed; and removing the temporary filler material to expose the plurality of slots in the outer tube and form a slotted liner.

Slots as used herein refers to openings (e.g., openings in conduits) having a size and shape that allows for the inflow of heavy oil/bitumen while reducing the entrance of sand or other wellbore debris, including, but not limited to, circles, ovals, squares, rectangles, triangles, slits or other regular or irregular shapes.

Temporary filler material as used herein refers to a material that is solid at reservoir temperatures, can withstand pressure during drilling, and will either liquefy when heated above the reservoir temperature or can be dissolved using a solvent material. Examples include, but are not limited to, various solders comprising a metal or a fusible metal alloy such as an alloy of tin, lead and/or silver, polymers, resins (see, for example, fluorine-containing meltable resin compositions as disclosed in U.S. Pat. No. 6,416,840, incorporated hereto by reference), fiberglass and plastics that can be liquefied by heat. In the alternative, resins known in the art can be used that can be dissolved using various hydrocarbon-based solvents. It is understood that the particular temporary filler material that will be used in a particular operation will depend on a number of factors, for example, without being limited, viscosity of the heavy oil/bitumen, operating pressure, temperature of the formation, and the desired method for removing the temporary filler material.

In one embodiment, the concentric drill string comprises a plurality of individual concentric drill pipe joints. In another embodiment, the concentric drill string comprises concentric coiled tubing.

In one embodiment, the well drilled is substantially vertical. In another embodiment, the well drilled is substantially horizontal. In another embodiment, the borehole starts and finishes from two different surface locations so that the drilling member and other downhole tools can be recovered at surface without removing the drill string from the hole.

In one embodiment, the concentric drill string further comprises an electronically driven submersible pump unit at its lower end for pumping the heated heavy oil or bitumen to the surface through the inner tube. Thus, the inner tube acts as a production tube. In the alternative, the heavy oil or bitumen can be removed through the inner tube by any number of alternate means, for example, an artificial lift, a surface pump jack, a progressive cavity pump, or the like.

In one embodiment, the outer tube comprises an electrical cable operably placed along the periphery of the outer tube and at least one induction heater operably associated with the electrical cable for heating the outer tube to liquefy and thus remove the temporary filler material and expose the slots. Thus, in this embodiment, the method further comprises providing electricity through the electrical cables to the at least one induction heater to heat the temporary filler material, thereby exposing the slots, and/or the formation to stimulate the flow of heavy oil or bitumen.

It is understood, however, that the outer tube could also be heated by other heating means known in the art, for example, but not limited to, circulating steam through the concentric drill string and thus liquefy the temporary filler material. For example, without being limiting, two parallel horizontal wells can be drilled using slotted concentric drill string. Steam can then be circulated through both drill strings to liquefy the temporary filler material. The upper horizontal well can then be used as an injector well for continuously injecting steam into the formation and the lower horizontal well can be used as a production well for collecting the heavy oil/bitumen as contemplated by SAGD.

In one embodiment, the temporary filler material is a resin that is removed by dissolving the resin with a hydrocarbon-based solvent. The solvent used will depend on the resin used to make the temporary filler material.

In one embodiment, the outer tube is made from a conductible material such as steel, aluminum or other materials known in the art. In another embodiment, the outer tube is continuously heated to stimulate the flow of the heavy oil or bitumen.

In another broad aspect, a method for drilling, completing and/or stimulating a heavy oil or bitumen well in a heavy oil or bitumen reservoir is provided, comprising:

providing a single wall drill string having a plurality of slots sealed with a temporary filler material;

drilling a borehole into the reservoir using a drilling member connected at the lower end of the single wall drill string and delivering drilling medium through the single wall drill string and extracting the exhaust drilling medium through an annulus formed between the single wall drill pipe and the borehole wall;

leaving the single wall drill string in the well after drilling of the borehole is completed; and removing the temporary filler material to expose the plurality of slots in the single wall drill pipe and form a slotted liner.

In one embodiment, the method further comprises inserting a production tube through the single wall drill string once drilling is completed.

In another broad aspect of the present invention, an apparatus for drilling, completing and/or stimulating a wellbore in a heavy oil or bitumen formation is provided, comprising:

a concentric drill string having an inner tube and an outer tube defining an annulus therebetween, the outer tube further having a plurality of slots; and removable temporary filler material for sealing the plurality of slots.

In another broad aspect of the present invention, an apparatus for drilling, completing and/or stimulating a wellbore in a heavy oil or bitumen formation is provided, comprising:

a concentric drill string having an inner tube and an outer tube defining an annulus therebetween;

an electrical cable operably placed along the periphery of the outer tube; and at least one induction heater operably associated with the electrical cable for heating the outer tube.

In one embodiment, the outer tube of the concentric drill string comprises a plurality of slots that are sealed with a temporary filler material.

In another broad aspect of the present invention, an apparatus for drilling, completing and/or stimulating a wellbore in a heavy oil or bitumen formation is provided, comprising:

a single wall drill string having a plurality of slots; and removable temporary filler material for sealing the plurality of slots.

In another broad aspect of the present invention, an apparatus for drilling, completing and/or stimulating a wellbore in a heavy oil or bitumen formation is provided, comprising:

a single wall drill string;

an electrical cable operably placed along the periphery of the single wall drill string; and at least one induction heater operably associated with the electrical cable for heating the single wall drill string.

In one embodiment, the single wall drill string comprises a plurality of slots that are sealed with a temporary filler material.

It is understood that the method and apparatus described herein can be used to drill both a vertical and a horizontal well. When drilling horizontally, additional directional downhole tools known in the art may be added to the concentric or single wall drill string.

In another broad aspect, either the concentric slotted drill string comprising electrical cable and at least one induction heater or the single wall slotted drill string comprising electrical cable and at least one induction heater can be used solely for stimulating a pre-existing drilled wellbore. For example, a wellbore can initially be drilled by any conventional drilling method and the drill string removed. Then, to stimulate the flow of the heavy oil or bitumen, either the concentric slotted drill string comprising electrical cable and at least one induction heater or the single wall slotted drill string comprising electrical cable and at least one induction heater can be delivered into the wellbore to heat the heavy oil or bitumen formation. With this broad aspect, the slots do not need to be filled with a temporary filler material as the strings are not being used to drill the wellbore and are only being used as slotted casing/production tubing (concentric) or slotted casing (single wall).

It is understood that the slotted concentric drill string need only be used for the portion of the formation that contains the heavy oil or bitumen. Thus, once the appropriate numbers of joints of slotted concentric drill string have been added, one can then switch to adding joints of non-slotted concentric drill string to continue drilling. Switching to non-slotted joints of concentric drill string will not only reduce overall costs, it will also provide a means for any gas produced in the heavy oil or bitumen formation to be removed at surface once the well is completed.

As the heavy oil or bitumen is heated, gas may also be released from the heavy oil or bitumen formation. However, the primary seals of the wellhead will prevent gas from escaping through the annulus formed between the wellbore and the concentric drill string. By providing a portion of the concentric drill string where the outer tube is non-slotted, another annulus will be provided between the inner tube and the outer tube of the non-slotted concentric drill string for the gas to escape. Thus, any gas produced in the heavy oil or bitumen formation can initially go through the slotted portion of the concentric drill string and then go up the annulus of the non-slotted portion of the concentric drill string to be safely removed at surface.

In one embodiment, the electric cable is a heat and oil resistant electrical cable and provides electricity to the induction heaters and other downhole tools. The outside walls of the drill string are slotted and these slots are filled with any material that can melt when heat is applied. For example, the filler material can be a solder or resin type material. Thus, during drilling operations, the slots will be sealed thereby allowing the concentric drill string to maintain pumping pressure for the drilling fluids. Once the drilling operations have been completed, the drill string will set in the slips in the wellhead. The slips are predesigned, tapered rings that have internal teeth. The weight of the drill string will cause the teeth to grip the drill string and hold it in place.

Once drilling is complete, the concentric drill string can remain in the formation and be used as a production string. The outer tube serves as a slotted liner once the filler sealing the slots is melted. The inner tube serves as the production tube for removal of heavy oil or bitumen to the surface of the well. Thus, the present invention allows the heavy oil or bitumen to flow into the slotted liner where it can be pumped up the inner tube to surface. In order to stimulate the flow of heavy oil or bitumen, the at least one electrical operated induction heater provides efficient and effective heat for stimulation of heavy oil and bitumen.

Electricity can be provided to the drill string through the wellhead to the induction heaters. These heaters will melt the solder or resin type material contained in the slots. The outside of the drill string is now transformed into a slotted liner for production purposes.

When required, selected holes may be placed in the center tube to allow inflow of oil or bitumen that is pumped to surface by an artificial lift system. A perforating gun on a wire line or other methods know in the industry, can be used to make the holes in the center tube.

Current technology requires the wellbore to be cleaned so the slotted liner can be run after the drill string has been removed from the well. Many of the slots become plugged while the liner is run into the well bore, particularly in horizontal wells where hole cleaning can be very difficult. Using heat to change the drill string into the production string eliminates plugged slots and reduces the time to complete the well.

The induction heater can stimulate the flow of heavy oil or bitumen into the slotted liner from the reservoir. Other means of stimulation can be applied from surface through the dual completion string as well. Such stimulation method could include steam, gases such as carbon dioxide, nitrogen and propane and various solvents. Combination of induction heating with other methods of stimulation can also be used with this invention.

The invention herein may offer one or more advantages over current conventional drilling and stimulation technology. For example, the drilling process using concentric drill string may reduce formation damage, provide better hole cleaning, and lower the risk of lost circulation. Furthermore, because the concentric drill string may also act as a dual wall completion string, this allows produced sand from the reservoir to be removed from the annulus between the inner tube and the slotted liner. A complete cleanout process using reverse circulation is described in more detail in U.S. Pat. No. 7,066,283, incorporated herein by reference.

By way of example, and not meant to be limiting, a concentric drill string as contemplated herein may have an outer tube having an outer diameter of 9⅝" and an inner tube having an outer diameter of 5". The annulus formed between the inner tube and outer tube will then be sufficiently large in area that one can then deliver concentric coil tubing having an outer tube having an outer diameter of 2⅞" and an inner tube having an outer diameter of 1" through the annulus to clean out any sand that has accumulated in the annulus by using reverse circulation cleanout, as detailed in U.S. Pat. No. 7,066,283, to lift the sand out with air, mud pumps, and the like.

The same annulus, when required, can also be used to produce gas associated with the heavy oil or bitumen or found in zones directly above these reservoirs as described above.

Thus, the present application provides a concentric drill string that may be used for both drilling and as a dual production string and at the same time may provide a very efficient source of induction heating for stimulating the well. Heavy oil and bitumen require heat to make this oil more moveable and, with induction heating, heat can be provided as needed. This may also allow electricity to be purchased at off—peak demand times, which provides cheaper electrical rates. If enough gas is produced from the formation, it can be used to provide electricity, for example, to run the induction heaters. Further, there may be a reduction in water usage and allows for the use of $CO_2$ and other gases to provide additional stimulation.

In one broad aspect, the present application may allow a heavy oil or bitumen well to be drilled with less damage, lower risk of lost circulation, and when the drilling is finished, the well is completed and ready for stimulation.

In one embodiment, more that one induction heater is used. These heaters may be strategically located on the outside of the drill string to provide thermal heat for two different purposes. First, the heaters provide enough heat to melt the solder or other filler material that is located inside the many slots on the outer diameter of the concentric drill string. Once the filler material has been melted, the concentric drill string can be used as a concentric production string. Oil or bitumen can enter the production string through the slots and is pumped to surface through the center of the inner tube.

A second purpose of the induction heaters can be to provide thermal energy and heat the heavy oil and bitumen. This heat provides stimulation to the reservoir and allows heavy oil and bitumen to flow in through the slots created in the concentric production string In another aspect, the present application also allows formation gas and production sand to flow into the slotted concentric production string. The gas will flow up the annulus between the inner tube and the outer tube of the portion of the concentric drill string that is non-slotted. The concentric drill string will have solid outer wall, with no slots, once it is above the last known hydrocarbon producing zones. At this point the gas will flow to surface, to the wellhead, using the annulus between the inner tube and the outer production string. A gas line can be attached to the wellhead to transport the gas to market or to a gas generator.

In another aspect, the present application allows for the removal of any produced sand that may build up on both the inside and the outside of the concentric production string. This problem can be dealt with by using reverse circulation clean out technology periodically to clean both the outside and the inside of the production string. The string does not have to be pulled out of the well to have sand or wax removed. Unlike much of the current technology that uses steam, which requires a lot of water and natural gas to produce, the present application may not require steam, as electrical induction heat may be used to heat the oil or bitumen. While in some instances steam may also be used, much less steam is likely required. Therefore, thinner reservoirs, where steam will not work, can be economically produced with the present invention.

Steam stimulation, for example, SAGD, requires two horizontal wells be drilled, one for steam stimulation and one for production. The present method and apparatus can be used to drill and complete such horizontal wells. In the alternative, the present method and apparatus can be used to drill a single well that can operate as a stimulating well, a production well or both, which is a significant saving on capital, as a wellhead and pumping system are the only surface facilities required, which take up less land and capital than a steam injection facility.

The present application allows special heat conductive drill pipe to be manufactured and used as the production string. Because this drill pipe is only used once and permanently left in the well, it doesn't have to be made to the durable standards of regular drill pipe.

Formation damage and lost circulation problems increase significantly when pipe must be moved in and out of a well bore that has good permeability and porosity. Horizontal wells tend to damage and have hole cleaning problems that may be significantly reduced with the present method and apparatus.

In another broad aspect, a horizontal well pattern that allows the heating of the heavy oil or bitumen reservoir in a controlled manner which is based on the thermal efficiency of the induction heaters is provided. Large diameter concentric drill pipe may be used to drill a long horizontal well from surface. The far end of this well is also returned to surface and this type of horizontal drilling process is called a Two Surface Location System (TSLS). The bottomhole assembly containing various drilling and directional tools may be retrieved using this process. A wellhead is also placed on the far end of the well, the electrical cable is attached to the electrical source at surface and production equipment such as electrical submersible pumps (ESP) can be installed.

The concentric drill string is heated, the slots are opened on the outside diameter of the pipe and the concentric drill string now becomes a concentric production string.

The Two Surface Location System having two wellheads may provide one or more of the following advantages:

(1) It allows for the retrieval of very expensive downhole tools;
(2) The well can be produced or stimulated from both ends;
(3) The well can be cleaned of sand and other material much easier and more efficiently;
(4) Artificial lift equipment located downhole such as ESP's can be installed and serviced much easier; and
(5) Well abandonment at the end of the production cycle is much easier and cheaper to do.

Another embodiment allows horizontal wells to be drilled from surface perpendicular to the first long horizontal well drilled into the field. This increases the thermal stimulation and oil or bitumen production in that field. Other methods of stimulation can be used once the concentric drill string has been changed to a concentric production string.

In another embodiment, concentric coiled tubing having both electrical cable and induction heaters on the outside coil is used to heat the heavy oil or bitumen. The coiled tubing is not slotted and is only used as a cheaper method to drill and heat the reservoir. Again the two surface location system may be used to allow the retrieval on the bottom hole well assembly and for ease of well abandonment at a future date. The new hybrid rigs that are being used today have both drill pipe and coiled tubing available on the same rig.

Where formation damage and lost circulation are not a concern, single wall coil or drill pipe equipped with electrical cable and induction heaters can be used to heat the oil or bitumen, in the offsetting perpendicular wells.

The present invention can be used with other stimulation methods involving steam, carbon dioxide and other gases where the concentric drill string is left in the well bore and used as the production string.

In another embodiment, the well may be drilled with a conventional drill string or a concentric drill string that is tripped back out of the well bore. Slotted casing, equipped with induction heaters and an electric cable is then run into the well to stimulate and produce the heavy oil or bitumen.

Finally, both heavy oil and bitumen reservoirs have very low recovery rates compared to light oil and natural gas. Much of this is due to formation damage, loss circulation problems, limited stimulation success and high capital costs. The method and apparatus described herein may resolve these problems and may provide higher recovery rates with less capital employed.

BRIEF DESCRIPTION OF THE DRAWINGS

The features and advantages of the invention will become more apparent from the following detailed description of the embodiment with reference to the attached diagrams wherein.

DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1A:
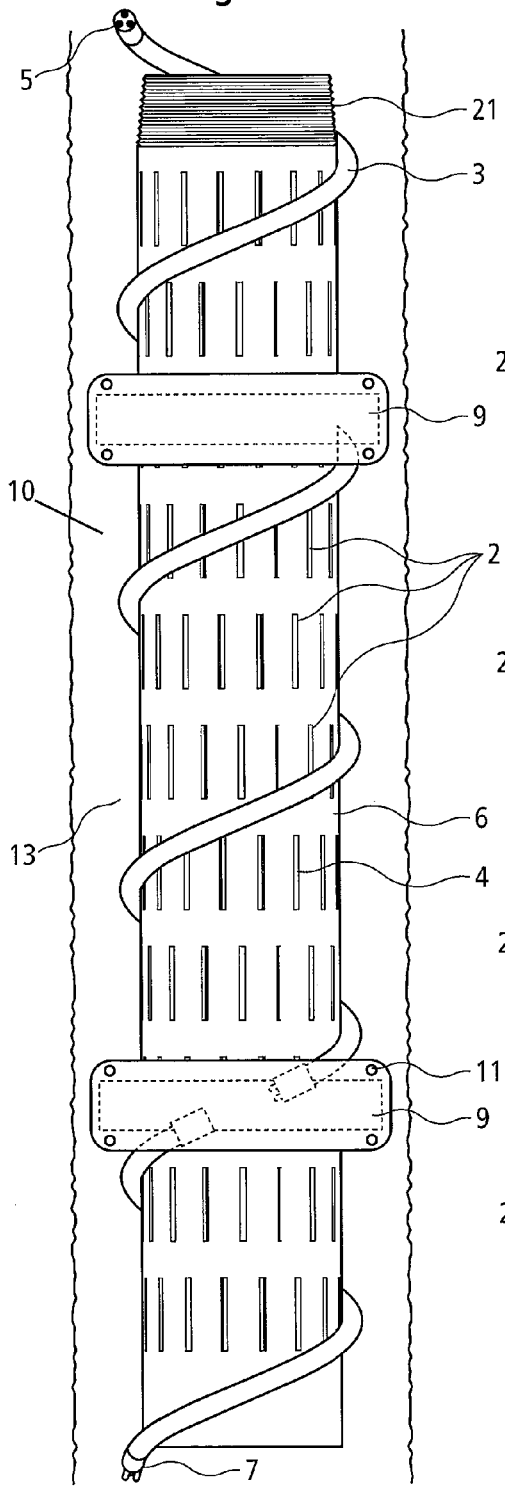
FIG. 1*a* is a perspective view of one embodiment of a joint of concentric drill pipe of the present invention.
Figure 1B:
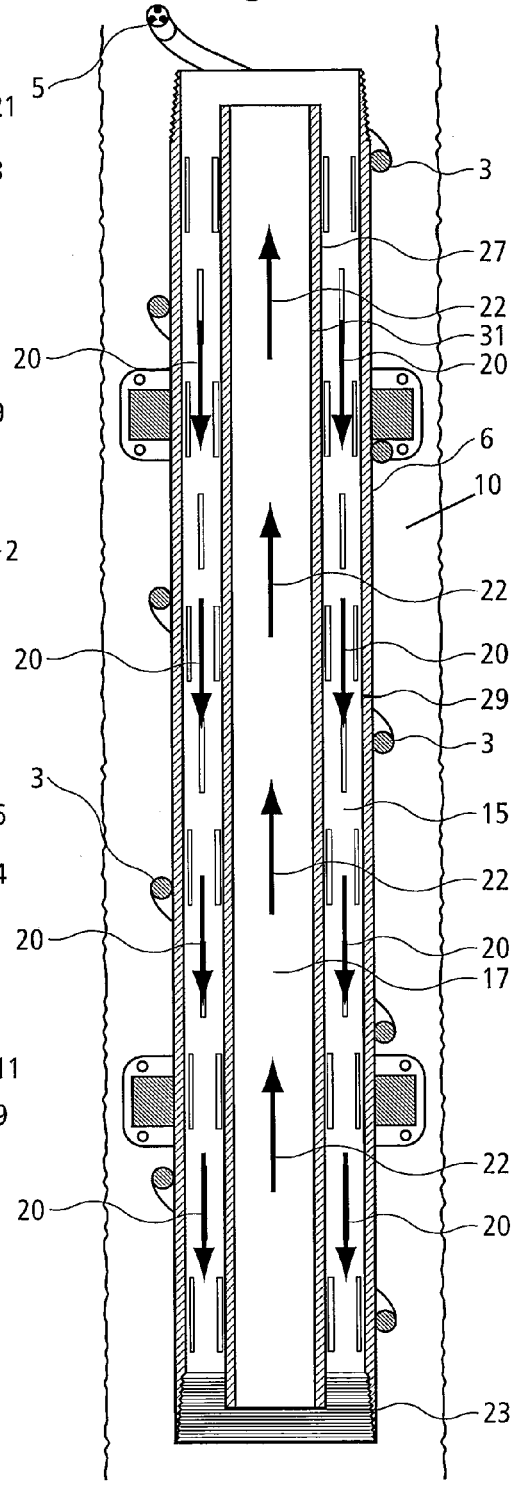
FIG. 1*b* is a vertical cross-section of the joint of concentric drill pipe of FIG. 1 a showing a flow pattern of drilling fluid during drilling operations.

With reference now to FIGS. 1*a* and 1*b*, FIG. 1*a* is a perspective view and FIG. 1*b* is a vertical cross sectional view of a joint of slotted concentric drill pipe 10 which can be used to form one embodiment of concentric drill string useful in the present invention. It is understood, however, that a continuous length of slotted concentric coil tubing can also be used in the present invention. It is further understood that the entirety of the concentric drill string does not necessarily need to be slotted. Thus, the concentric drill string comprised of concentric drill pipe may include both joints of slotted concentric drill pipe 10 and non-slotted joints of concentric drill pipe.

Concentric drill pipe joint 10 is shown situated inside wellbore 13. In this instance, wellbore 13 is vertical but it is understood that the wellbore could also be horizontal.

Each joint of slotted concentric drill pipe 10 comprises a threaded pin connection 21 and a threaded box connection 23, so that additional joints of concentric drill pipe can be added as drilling downhole progresses by threading threaded pin connection 21 into threaded box connection 23. Concentric drill pipe joint 10 further comprises an outer tube 6 and an inner tube 31, whereby the outer tube 6 has a plurality of slots 2 that have been cut therethrough. Slots 2 are filled or sealed with a bonding material 4 such as solder or resin that allows the concentric drill string to retain its pressure integrity during drilling operations.

Electrical cable 3 is wrapped around the periphery of concentric drill pipe joint 10 and provides a source of electricity to operate induction heaters 9 which are attached to concentric drill pipe joint 10 by a series of bolts, pins or other attachment means 11. It is understood that similar electrical cable can be wrapped around the periphery of the entire length of the concentric drill string as described below.

Each time a new joint of concentric drill pipe is threaded to the concentric drill string, electrical cable 3 is joined to the new joint of concentric drill pipe by joining together female plug 5 of the growing concentric drill string with male plug 7 of the new joint of concentric drill pipe. Thus, a continuous electrical connect will be made from the top of the concentric drill string to the bottom of the concentric drill string. This allows electricity conductivity each time a joint of pipe is added to the drill string.

FIG. 1*b* is a vertical cross section of FIG. 1*a*, showing the flow of drilling medium in one embodiment of the present invention. Drilling medium, which can include drilling mud, drilling fluid, gas such as air, nitrogen and the like, or any combinations thereof, is delivered (shown by arrows 20) through annulus 15, which annulus 15 is formed by the outer wall 27 of inner tube 31 and the inner wall 29 of outer tube 6. When necessary, a perforating gun or other means known in the art can be run in with a wire line to perforate the inner tube 31, thereby allowing the inflow of heavy oil or bitumen into the inner tube. Spent or exhaust drilling fluid is removed through the central passageway 17 of inner tube 31 as shown by arrows 22, where exhaust drilling medium and cuttings are returned to surface. When required, downhole tools such as logging tools, perforating guns, seismic tools, video cameras, and the like can be run in through inner tube 31 on a wire line. It is understood that in addition to drilling medium, stimulation material, production sand, chemicals, kill fluid and other material can be pumped down annulus 15.

Figure 1C:
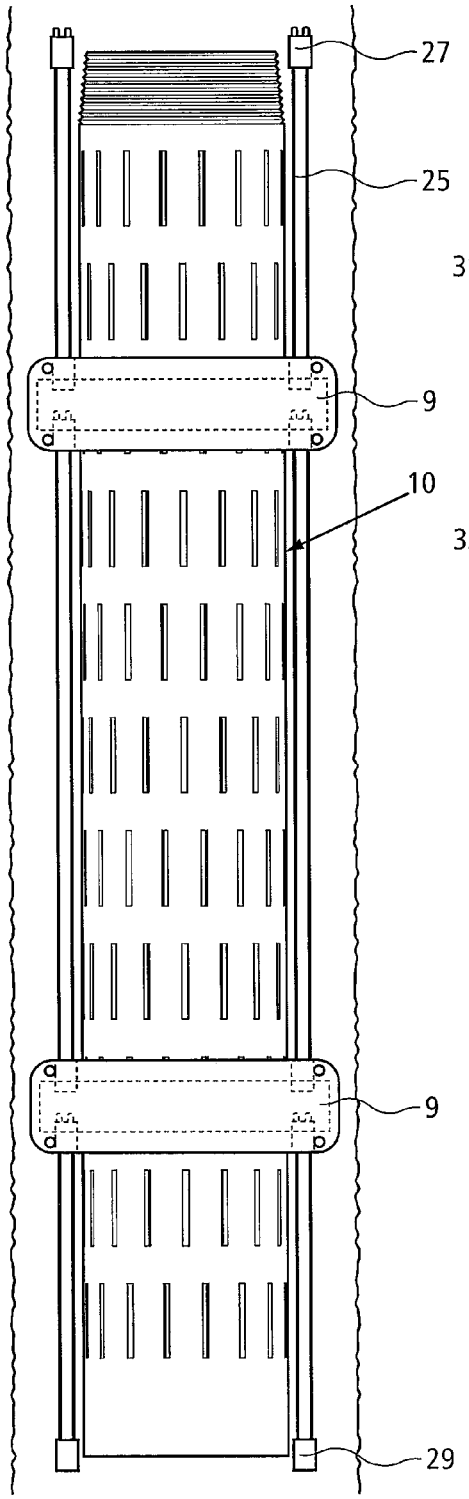
FIG. 1*c* is a perspective view of another embodiment of a joint of concentric drill pipe of the present invention.
Figure 1D:
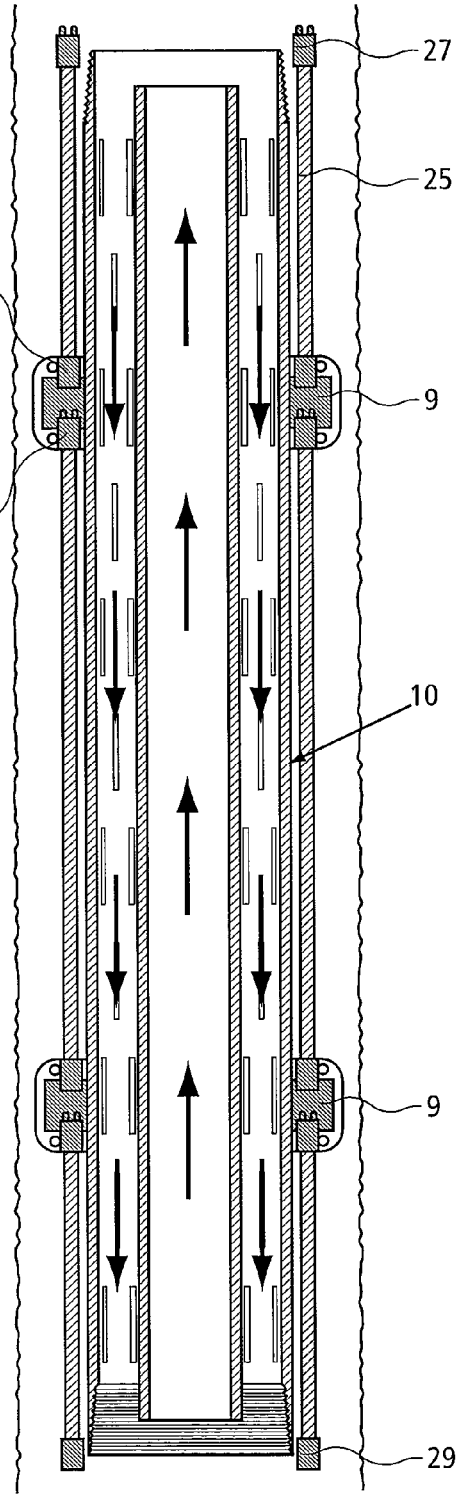
FIG. 1*d* is a vertical cross-section of the joint of concentric drill pipe of FIG. 1*c*.

FIGS. 1*c* and 1*d*, which are a perspective and a vertical cross sectional view, respectively, of a joint of concentric drill string 1 of the present invention, shows another embodiment of a cable that can be used. Unlike the wrapped electric cable 3 shown in FIGS. 1*a* and 1*b*, metal coated electric cable 25 comprising male plug 27 and female plug 29 runs alone the length of the joint of concentric drill pipe. Each time a joint of concentric drill pipe, for example, concentric drill pipe joint 10, is added to the growing concentric drill string, male plug 29 is joined to female plug 29 of the previous joint of concentric drill pipe. FIG. 1*d* also illustrates how inductor heaters 9 are wired together when using metal coated electric cable 25 as the downhole electric source. Male plug 33 is attached to female plug 31 to provide a continuous electrical current for continuous electrical conductivity.

In operation, slotted concentric drill string whereby the slots are sealed with bonding material such as solder or resin is first used to drill a borehole with minimum damage to the heavy oil or bitumen formation. Once the wellbore is formed, the concentric drill string can now remain in the wellbore to either stimulate the flow of heavy oil and bitumen or collect the heavy oil or bitumen for removal to the surface of the wellbore or both. For example, an electrical current is run through the electrical cables to operate the at least one induction heater. The induction heater heats the concentric drill string thereby melting or liquefying the solder to expose the slots. The induction heater also operates to heat the formation and therefore heat the heavy oil or bitumen so that it can now flow from the formation through the slotted liner (i.e., slotted outer tube) and the bitumen can be removed by an artificial lift through the inner tube, which now serves as a production tube.

In some formations where there may be safety concerns, e.g., blowout concerns, or if required by government regulations, it may be necessary to provide a downhole flow control device for controlling the flow of gaseous hydrocarbons through the inner tube or the annulus or both of the concentric drill string during the drilling operation. Downhole flow control devices that may be used in these situations are described in more detail in U.S. Pat. Nos. 6,892,829 and 6,854,534, both of which are incorporated herein by reference.

Figure 2:
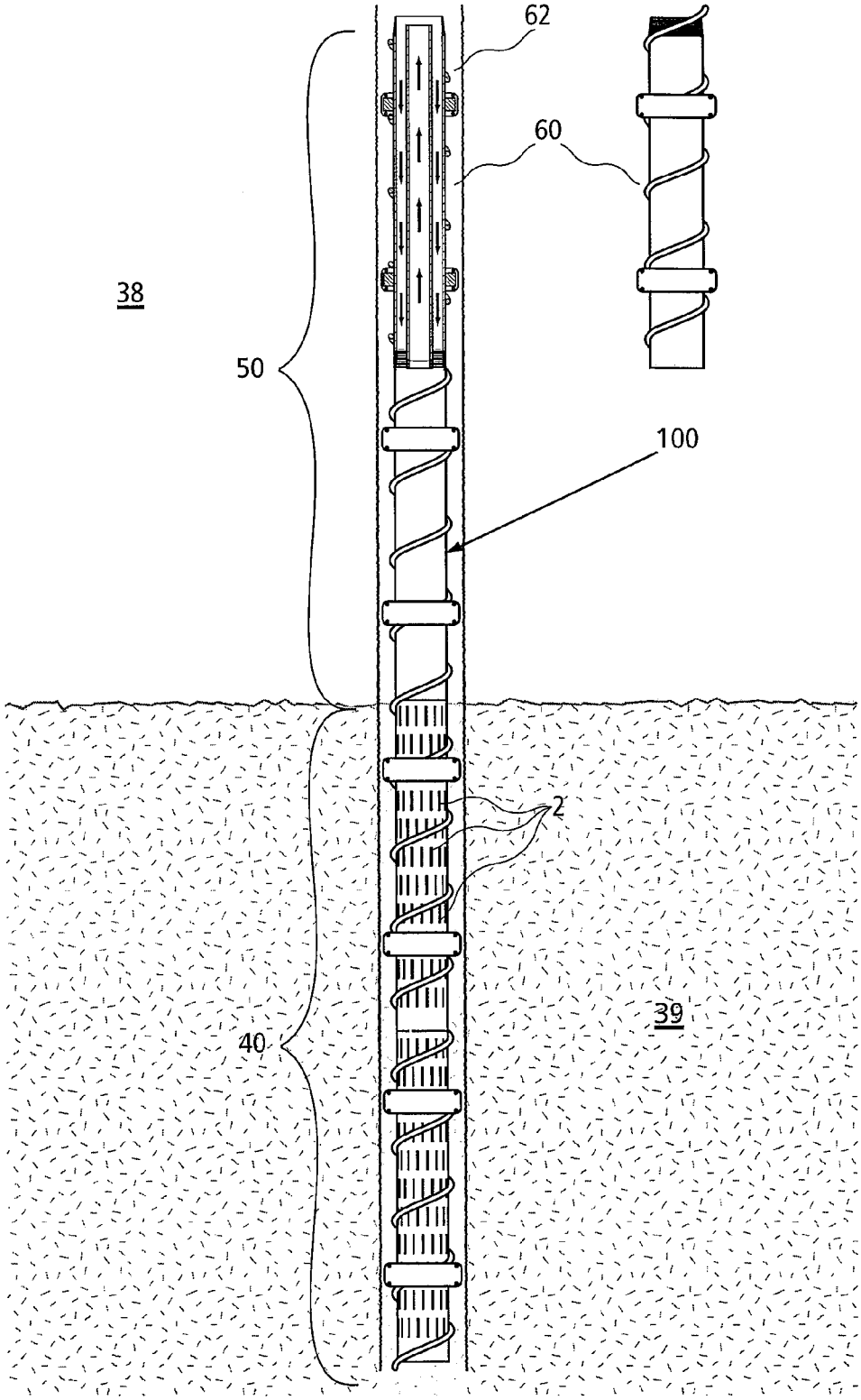
FIG. 2 is a perspective view of an embodiment of concentric drill string with the electrical cable and induction heaters attached in the vertical position within a well bore.

FIG. 2 is a perspective view of an embodiment of concentric drill string 100 whereby a portion 40 of the concentric drill string 100 in the heavy oil or bitumen formation 39 comprises slots 2 and a portion 50 of the concentric drill string 100 that is not in the heavy oil or bitumen formation does not comprise slots. The non-producing portion of the formation is shown in FIG. 2 as numeral 38. The last joint 60 of concentric drill string 100 is also shown in FIG. 2 in cross section to illustrate that the outer tube 62 is non-slotted. Thus, by providing a portion of the concentric drill string where the outer tube is non-slotted, another annulus will be provided between the inner tube and the outer tube of the non-slotted concentric drill string for the gas to escape. Hence, any gas produced in the heavy oil or bitumen formation can initially go through the slotted portion of the concentric drill string and then go up the annulus of the non-slotted portion of the concentric drill string to be safely removed at surface.

In FIG. 2, the drilling member (not shown) used to drill into the formation has been removed, i.e., "shot off", so that the inner tube can now be used as a production tube if desired. It is understood that the drilling member comprises a drill bit and may further comprise various downhole tools such as bent subs and the like that may be necessary for directional drilling when drilling a horizontal well.

Figure 3A:
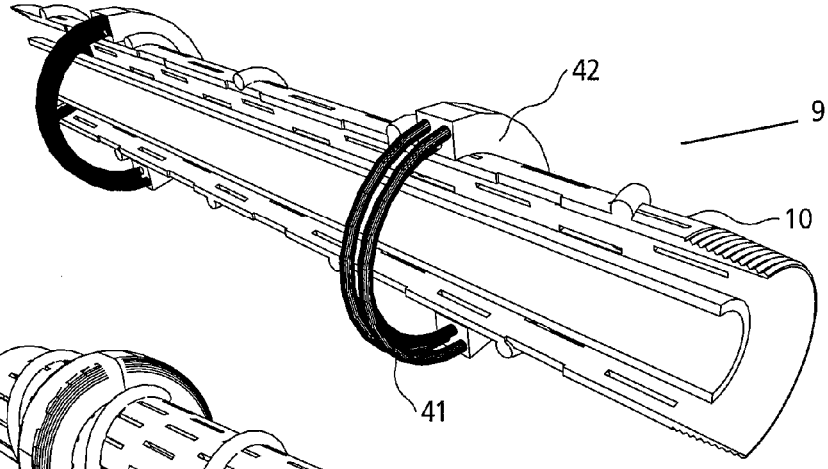
FIG. 3*a* is a horizontal cross section of an embodiment of an electrical induction heater operably associated with a concentric drill string of the present invention.
Figure 3B:
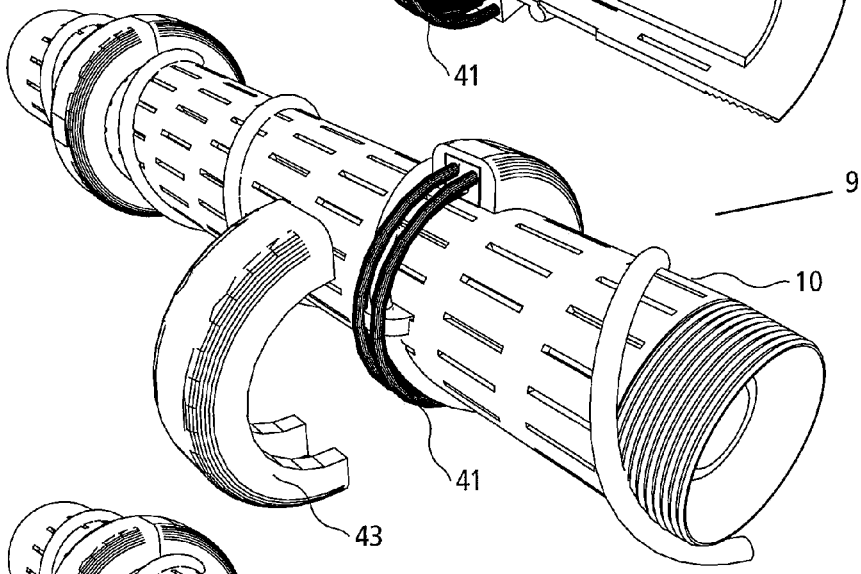
FIGS. 3*b* and 3*c* are perspective views of an embodiment of an electrical induction heater showing how the electrical induction heater is operably assembled on the concentric drill string.
Figure 3C:
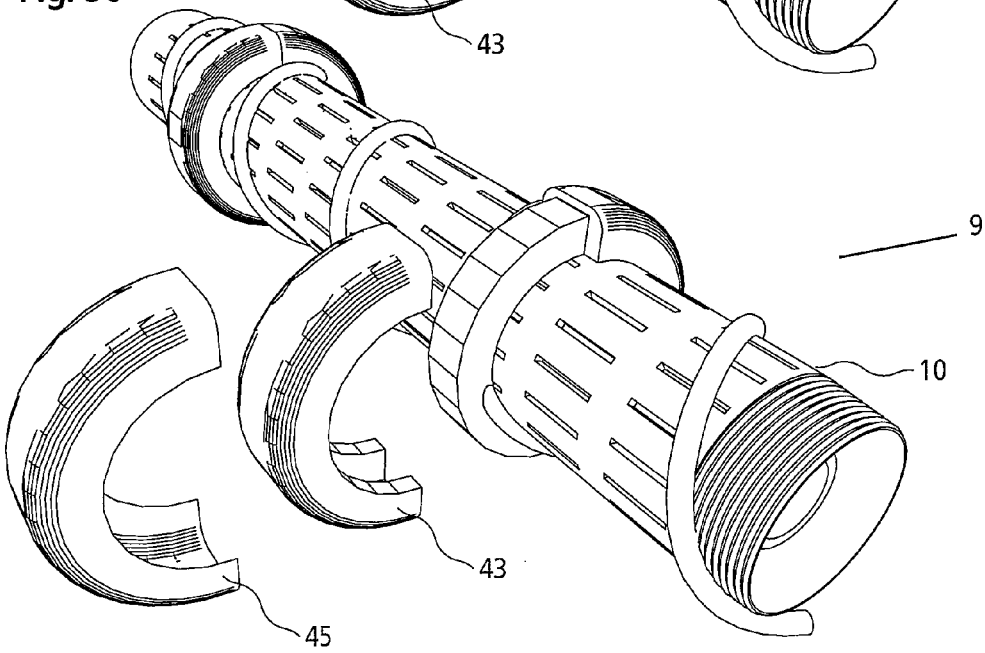

FIGS. 3*a*, 3*b* and 3*c* are a series of horizontal cross sections of a joint of concentric drill pipe 10 showing the various components of an embodiment of an induction heater that can be used in the present invention. The assembly of induction heater 9 is shown in series in FIGS. 3*a*, 3*b* and 3*c*. With reference now to FIGS. 3*a*, 3*b* and 3*c*, induction heater 9 comprises heating coils 41 that are wrapped with an insulation layer 42 to allow the induction heater to initially heat the length of slotted concentric drill pipe 10 to melt the temporary filler material that initially plug the slots. FIG. 3*b* shows that in one embodiment, the insulation layer 42 may be further wrapped with protective layer 43 to further maintain the heat in induction heater 9. Protective layer 43 may be made from any number of materials known in the art, for example, metal or other suitable material. FIG. 3*c* show that induction heater 9 may further comprise a protective cover 45 to protect the induction heater from the heavy oil or bitumen or other potentially damaging elements.

In another embodiment of the present invention, an unslotted concentric drill string can be used to drill the borehole and to stimulate the flow of heavy oil or bitumen in the formation. Once the heavy oil or bitumen is heated, the oil can then be removed through the concentric drill string by using an artificial lift, or the concentric drill string can be removed and other production tubing can be used to remove the heated heavy oil or bitumen. The concentric drill string can comprise a plurality of unslotted drill pipe joints or can be a concentric coil tubing drill string as shown in FIG. 4.

Figures 4A, 4B:
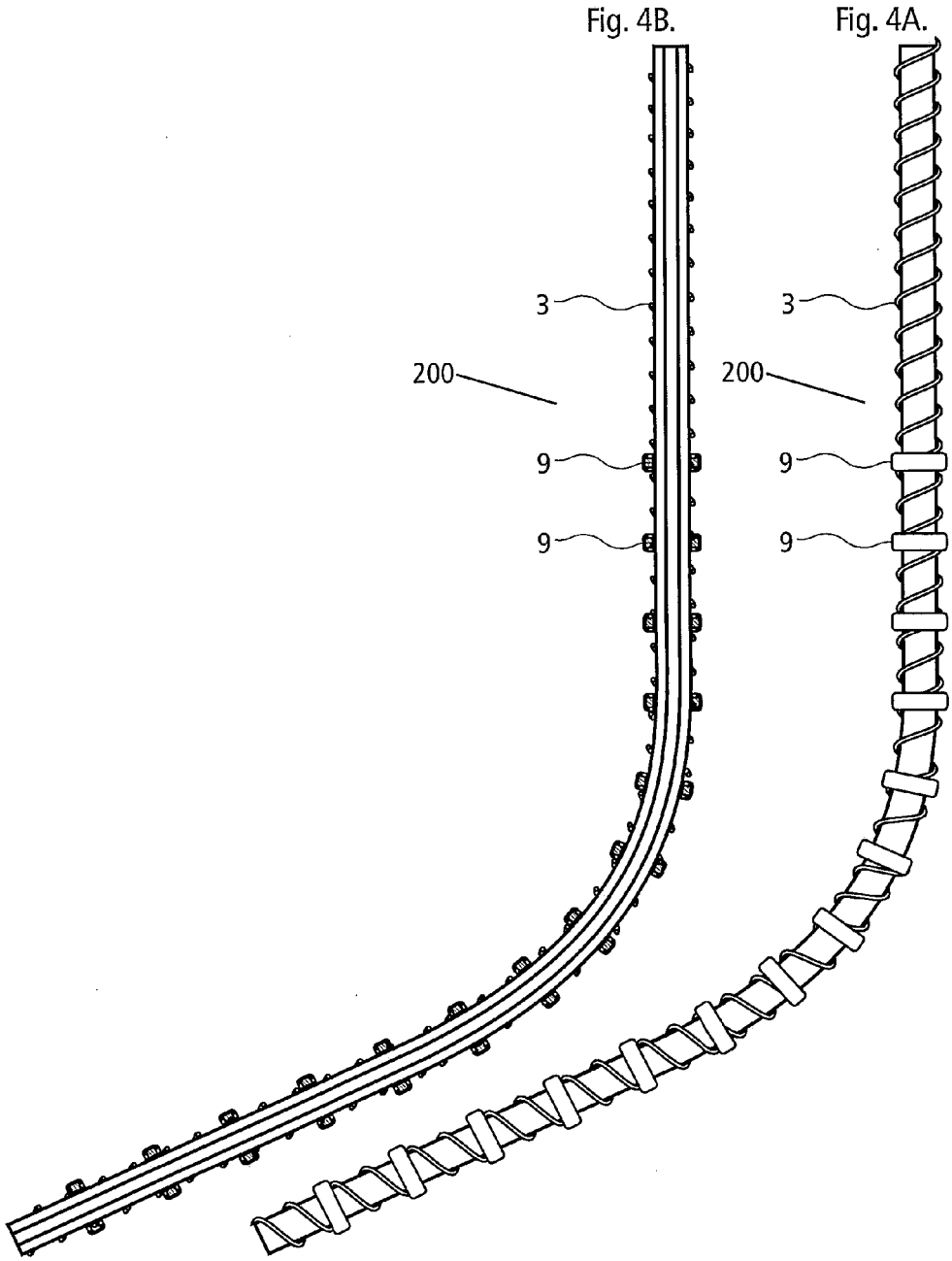
FIGS. 4*a* and 4*b* are a perspective view and cross sectional view, respectively, of concentric coiled tubing drilling string equipped with electrical cable and induction heaters.

FIG. 4A is a perspective view and FIG. 4B a cross sectional view of concentric coil tubing drill string 200 that has been equipped with induction heaters 9 and electric cable 3. The concentric coil tubing drill string can be used to both drill the borehole and to stimulate the flow of heavy oil or bitumen.

Figure 5:
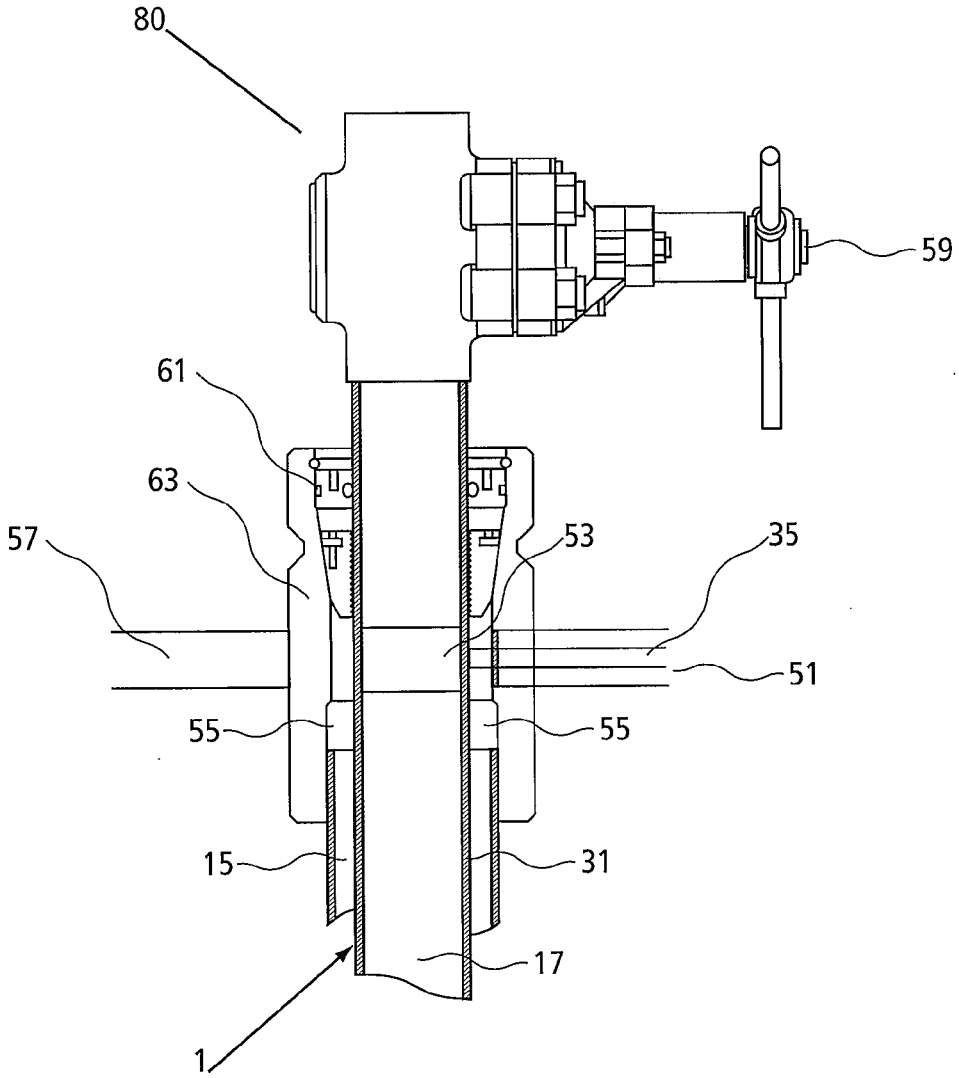
FIG. 5 is a cross sectional view of the wellhead used to complete a well formed using concentric drill string.

FIG. 5 is a vertical cross section view of a wellhead 80 that could be used in the present invention when drilling is completed to cap the well. The electrical source cable 35 from the power source (not shown) passes through outlet 51 inside the wellhead. Switchbox 53 connects the electrical source cable 35 to the main electrical cable (not shown) that is wrapped around or otherwise associated with the concentric drill string 1. Concentric drill string 1 is held in place within wellhead 80 with casing slips 63. Primary seal 61 isolates the annulus 15 on the outside of annulus 15 from the atmosphere. The central passageway 17 of the inner tube 31 is closed to atmosphere by valve 59.

When it is necessary to inject steam, gases or other simulation material and chemicals this can be done through side outlet 57. Check valve 55 will allow material to flow down annulus 15 but not in the upward direction.

The power source is operated from a central control room along with other instrumentation.

Figure 6A:
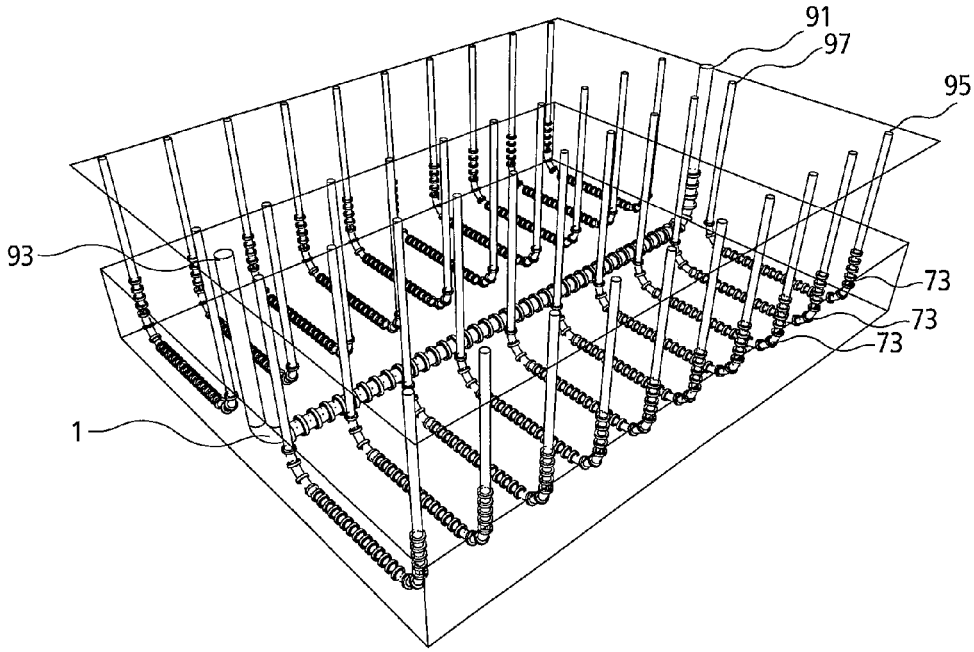
FIGS. 6*a* and 6*b* are a perspective view and aerial view, respectively, of a horizontal well pattern to stimulate and produce a heavy oil or bitumen reservoir.
Figure 6B:
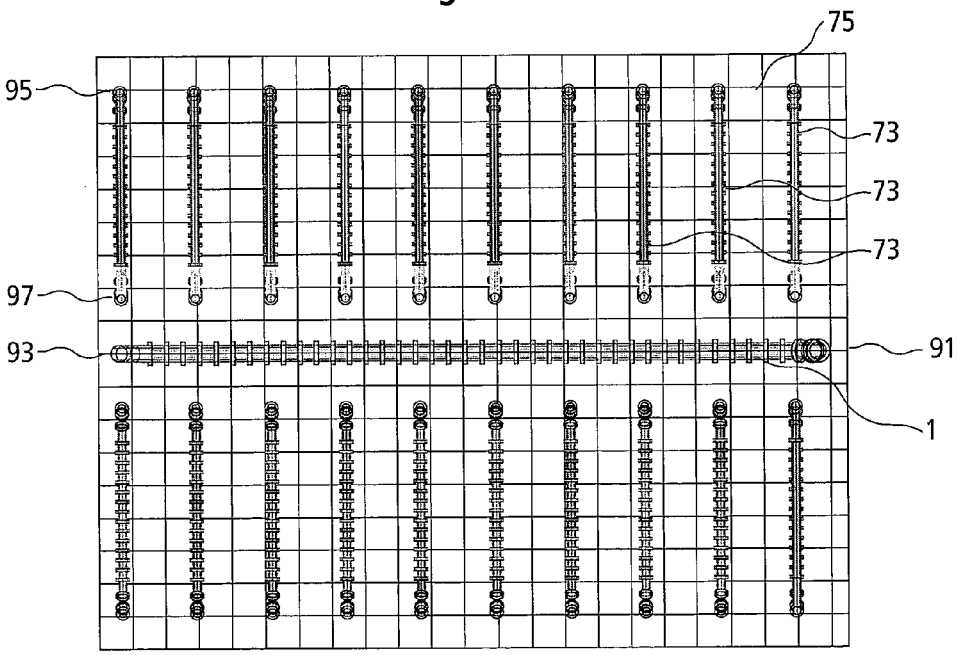

FIGS. 6*a* and 6*b* show a perspective view and aerial view, respectively, of a horizontal well drilling grid that may be used to produce a heavy oil/bitumen reservoir. As shown in FIG. 6*a*, a large diameter concentric drill string 1 having filled slots has been placed horizontally in the wellbore using the Two Surface Location System as described above, where drilling starting point 91 and drilling end point 93 can be capped with wellhead shown in FIG. 5. The large diameter concentric drill string 1 can then be heated with at least one induction heater. The heat will open the slots therein (not shown) and the concentric drill sting 1 can now operate as a production string.

Lateral wells 73 are drilled perpendicular from concentric drill string 1 to provide further stimulation to the reservoir. Lateral wells 73 are also drilled using two different surface locations 95 and 97, where each surface location may be equipped with a wellhead (not shown). Lateral wells 73 may be drilled with either slotted or non-slotted single wall or concentric drill string, each equipped with at least one induction heater. When drilling is completed, each string remains in the well where the at least one induction heater heats the heavy oil/bitumen reservoir to cause the heavy oil/bitumen to flow and collect in production string 1. When slotted drill string is used for lateral wells 73, each of these wells can also act as production strings as described above. FIG. 6*b* shows a grid pattern where each grid 75 has the same area to determine the optimum grid pattern for maximum heavy oil/bitumen recovery.

Figure 7A:
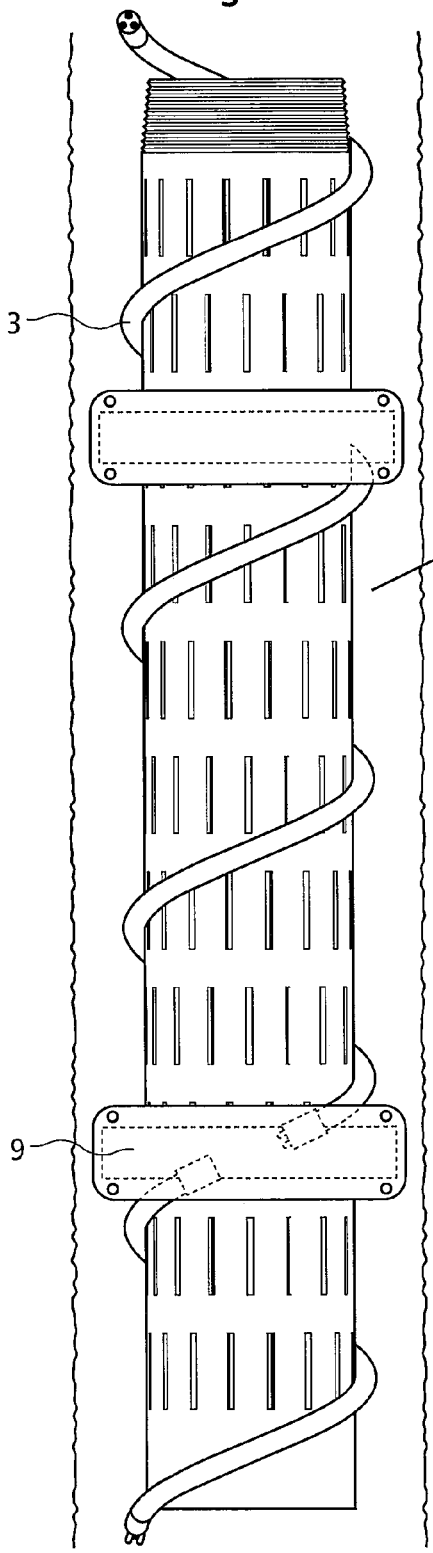
FIGS. 7*a* and 7*b* are a perspective view and a vertical cross sectional view, respectively, of a single wall drill string that can be used as a production tube having electrical cable and induction heaters attached to the outside.
Figure 7B:
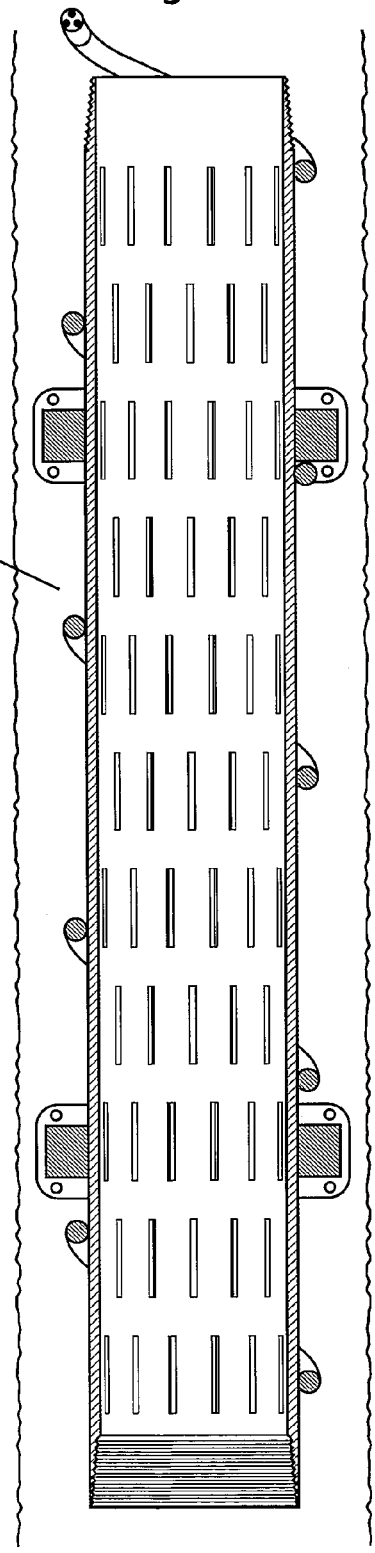

FIGS. 7*a* and 7*b* are a perspective view and a vertical cross sectional view, respectively, of single wall drill string 200 that can also be used to stimulate heavy oil or bitumen production and be left downhole to be used as a production tube. Single wall drill string comprises electric cable 3 and induction heater 9.

Figure 8A:
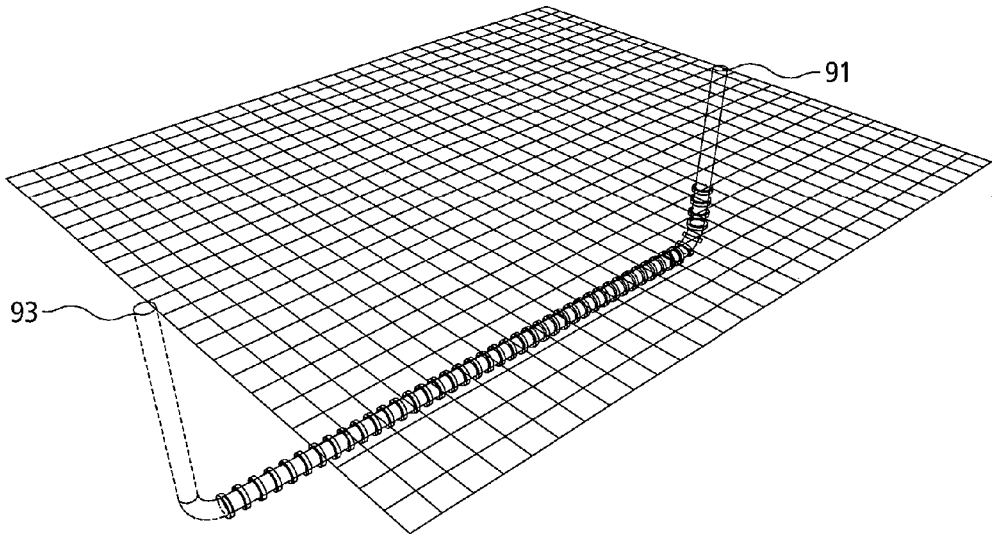
FIGS. 8*a* and 8*b* are a perspective view and an aerial view, respectively, of a single horizontal well drilled using the Two Surface Location System.
Figure 8B:
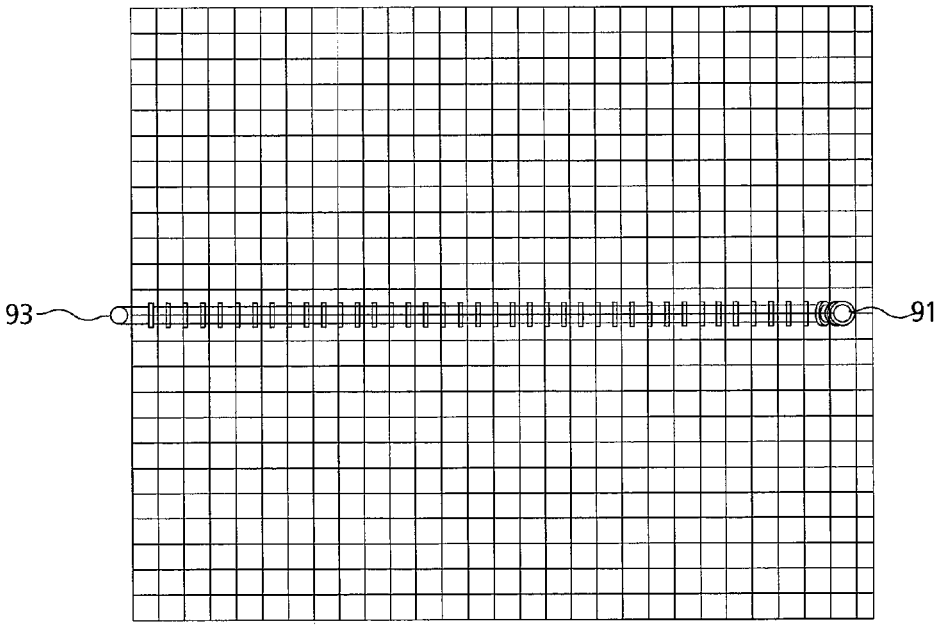

FIGS. 8*a* and 8*b* are a perspective view and aerial view, respectively, of a single horizontal well using the Two Surface Location System. As can be seen in FIG. 8*a*, the well starts and finishes from two different surface locations. A vertical portion of the well is first drilled starting at surface location 91. Then the well is drilled horizontally for a predetermined length. Finally, the well is completed by bringing the drilling member back to surface at surface location 93. Thus, a heavy oil or bitumen reservoir can be developed using a single well as shown here or a multi - well program as shown in FIGS. 6*a* and 6*b*. A wellhead as shown in FIG. 5 is attached to each surface location 91 and 93. This type of drilling system allows all of the downhole tools to be retrieved without removing the drill string and the well can be stimulated, produced or serviced from surface locations 91 and 93.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 U.S.C. 112, sixth paragraph, unless the element is expressly recited using the phrase "means for" or "step for".

I claim:

1. A method for drilling, completing and/or stimulating a heavy oil or bitumen well in a heavy oil or bitumen reservoir, comprising:

(a) providing a concentric drill string having an inner tube and an outer tube defining an annulus therebetween, the outer tube further having a plurality of slots sealed with a temporary filler material;

(b) drilling a borehole into the reservoir using a drilling member connected at the lower end of the concentric drill string and delivering drilling medium through one of the annulus or inner tube and extracting the exhaust drilling medium through the other of the annulus or inner tube;

(c) leaving the concentric drill string in the well after drilling of the borehole is completed; and (d) removing the temporary filler material to expose the plurality of slots in the outer tube and form a slotted liner.

2. The method as claimed in claim 1, wherein the temporary filler material is selected from the group consisting of solders, polymers, resins, fiberglass and plastics.

3. The method as claimed in claim 1, wherein the temporary filler material is removed by heating the outer tube.

4. The method as claimed in claim 1, wherein the temporary filler material is a resin and is removed with a hydrocarbon-based solvent.

5. The method as claimed in claim 1, wherein the well drilled is substantially vertical.

6. The method as claimed in claim 1, wherein the well drilled is substantially horizontal.

7. The method as claimed in claim 1, wherein the borehole starts and finishes at two different surface locations.

8. The method as claimed in claim 1, further comprising:

(e) controlling the flow of gaseous hydrocarbons through the inner tube, the annulus or both during drilling of the borehole.

9. The method as claimed in claim 1, wherein the outer tube comprises an electrical cable operably placed along its periphery and at least one induction heater operably associated with the electrical cable, further comprising:

(e) providing sufficient electricity through the electrical cable to the at least one induction heater for heating the outer tube to remove the temporary filler material and expose the plurality of slots.

10. The method as claimed in claim 9, further comprising:

(f) continuing to provide electricity through the electrical cable to the at least one induction heater after the temporary filler material have been removed from the slots to stimulate the flow of heavy oil or bitumen in the reservoir.

11. The method as claimed in claim 10, further comprising:

(g) removing the flowing heavy oil or bitumen from the reservoir to the surface through the inner tube.

12. A method for drilling, completing and/or stimulating a heavy oil or bitumen well in a heavy oil or bitumen reservoir, comprising:

(a) providing a concentric drill string having an inner tube and an outer tube defining an annulus therebetween, the outer tube comprising a plurality of slots sealed with a temporary filler material, an electrical cable operably placed along its periphery and at least one induction heater operably associated with the electrical cable;

(b) drilling a borehole into the reservoir using a drilling member connected at the lower end of the concentric drill string and delivering drilling medium through one of the annulus or inner tube and extracting the exhaust drilling medium through the other of the annulus or inner tube;

(c) leaving the concentric drill string in the well after drilling of the borehole is completed; and (d) providing sufficient electricity through the electrical cable to the at least one induction heater for heating the outer tube to remove the temporary filler material and expose the plurality of slots.

13. The method as claimed in claim 12, further comprising:

(e) continuing to provide electricity through the electrical cable to the at least one induction heater after the temporary filler material have been removed from the slots to stimulate the flow of heavy oil or bitumen in the reservoir.

14. The method as claimed in claim 13, further comprising:

(f) removing the flowing heavy oil or bitumen from the reservoir to the surface through the inner tube.

* * * * *